US007665401B2

(12) United States Patent
Ballantine et al.

(10) Patent No.: US 7,665,401 B2
(45) Date of Patent: Feb. 23, 2010

(54) SHOCK TUBE INITIATOR

(75) Inventors: Roger Ballantine, Lower Hutt (NZ); Anthony Paul Hornbrook, Lower Hutt (NZ); Ian Moore, Lower Hutt (NZ); Dave Norman Hamilton, Upper Hutt (NZ)

(73) Assignee: Mas Zengrange (NZ) Ltd (NZ)

( * ) Notice: Subject to any disclaimer, the term of this patent is extended or adjusted under 35 U.S.C. 154(b) by 638 days.

(21) Appl. No.: 10/596,138

(22) PCT Filed: Dec. 1, 2003

(86) PCT No.: PCT/NZ03/00264

§ 371 (c)(1),
(2), (4) Date: Jun. 1, 2006

(87) PCT Pub. No.: WO2005/054073

PCT Pub. Date: Jun. 16, 2005

(65) Prior Publication Data

US 2008/0276818 A1 Nov. 13, 2008

(51) Int. Cl.
*C06C 5/06* (2006.01)

(52) U.S. Cl. ..... 102/275.11; 102/275.6; 102/322; 102/331

(58) Field of Classification Search ..... 102/275.6, 102/275.11, 200, 204, 301, 322, 331
See application file for complete search history.

(56) References Cited

U.S. PATENT DOCUMENTS 4,381,711 A 5/1983 Lawrence
4,962,708 A 10/1990 Snyder et al.
6,581,519 B1 6/2003 Adams
7,451,700 B1 * 11/2008 Land ..... 102/218

FOREIGN PATENT DOCUMENTS

WO 0020821 A1 4/2000
WO WO 2005054073 A1 * 6/2005

* cited by examiner

*Primary Examiner*—James S Bergin
(74) *Attorney, Agent, or Firm*—Brooks Kushman P.C.

(57) ABSTRACT

A shock tube initiator (STI) for allowing the remote and/or manual initiation of at least one shock tube, typically two shock tubes is disclosed. The STI consists of: a) at least one coupling 8, connected to a shock tube containing a shot shell primer that upon firing initiates burning of the shock tube, b) a cockable mechanical firing mechanism 7 adjacent to the coupling 8 wherein the mechanical firing mechanism 7 is adapted to strike respective firing pins 9 within the couplings, c) a safety mechanism 15 adapted to allow the mechanical firing mechanism 7 to ignite said explosive charge only when the safety mechanism 15 is moved from a safe mode position to an armed position, d) a rotary solenoid valve 24, electrically connected to and energised by a remote controlled operating system, and e) an actuator 10 positioned between and engageable with the rotary electro-mechanical energising means 24 and the firing mechanism 7 and wherein said actuator 10 is adapted to be actuated either by the rotary solenoid valve 24, when energised, or manually manipulated (13) to allow the cockable mechanical firing mechanism 7 when cocked, to ignite said shell primer.

27 Claims, 5 Drawing Sheets

SHOCK TUBE INITIATOR

FIELD OF INVENTION

The invention relates to a shock tube initiator, typically a dual shock tube initiator, designed to be initiated manually or by remote control, typically by a UHF/VHF digital radio controlled system.

BACKGROUND OF INVENTION

The detonation of explosives either in the military, mining or similar fields can be a very dangerous exercise, which if not done correctly can lead to catastrophic effects not just to the surrounding area but also to people within close proximity to the detonation area.

When using explosives there are two prime considerations that need to be dealt with, these being (1) placing the blaster a safe distance away from the explosion to prevent injury from flying debris, flames, concussion on a combination of the three, and (2) initiating the explosive at a safe distance (stand-off) between the blaster and the blast. The stand-off distance cannot be readily identified as a specific distance and as a consequence is directly related to many blasting accidents.

The common types of detonation of explosives used to provide a safe stand-off distance are (1) electric blasting using wire and electric blasting caps, (2) radio controlled blasting using communication telemetry and (3) initiation cord or tube.

The use of initiation cord requires sufficient energy to detonate the explosive. The use of initiation cord with an electric blasting cap can be dangerous since the blasting cap contains more explosive than is necessary to start the initiation cord and is prone to interference from radio frequency energy or high electro-magnetic fields which can cause premature detonation of the explosive.

Current known methods of using initiation cord with mechanical starters using a shell shot primer coupled to the initiation tube can also be dangerous. This is because the close proximity of the blaster to the detonating cord can cause injury due to the cord having an external burning rate of approximately 7000 meters per second.

While known explosive initiating devices fulfill their respective objectives and requirements they do not appear to describe an explosive initiating method and/or system that utilises the best features of the electric and mechanical initiators to provide safe and efficient initiating of explosives.

There have been previous attempts to use electro/mechanical initiators using a high current discharge capacitor to drive a linear solenoid to strike a shot shell primer. However, such initiators require high energy to operate and are generally only able to be fired electrically, not manually.

OBJECT OF INVENTION

It is an object of the invention to provide a shock tube initiator, typically a dual shock tube initiator that is operable by remote control or manual operation, which has improved reliability and that ameliorates some of the disadvantages and limitations of the known art or at least provides the public with a useful choice.

SUMMARY OF INVENTION

In one aspect the invention resides in a shock tube initiator, typically a dual shock tube initiator, for allowing the remote and/or manual initiation of at least one shock tube, preferably dual shock tubes, wherein the shock tube initiator includes in combination:

a) at least one coupling means operably connected to a shock tube and wherein the coupling means is adapted to house a shot shell primer containing an explosive charge that upon firing initiates burning of the shock tube, b) a cockable mechanical firing mechanism positioned proximal and adjacent to the coupling means wherein the mechanical firing mechanism is adapted to ignite said explosive charge, c) a safety mechanism adapted to allow the mechanical firing mechanism to ignite said explosive charge only when the safety mechanism is moved from a safe mode position to an armed position, d) a rotary electro-mechanical energising means operably electrically connected to and energised by a remote controlled operating system, and e) an actuating means adapted to be positioned between and engageable with the rotary electro-mechanical energising means and the firing mechanism and wherein said actuating means is adapted to be actuated either by the rotary electro-mechanical energising means, when energised, or manually manipulated to allow the cockable mechanical firing mechanism when cocked, to fire and ignite said explosive charge to initiate burning of the at least one shock tube when the safety mechanism is in the armed position.

In another aspect the invention resides in a shock tube initiator, typically a dual shock tube initiator, for allowing the remote and/or manual initiation of at least one shock tube, preferably dual shock tubes, wherein the shock tube initiator includes in combination:

a) at least one coupling means operably connected to a shock tube and wherein the coupling means is adapted to house a shot shell primer containing an explosive charge that upon firing initiates burning of the shock tube, b) a cockable mechanical firing mechanism positioned proximal and adjacent to the coupling means wherein the mechanical firing mechanism is adapted to ignite said explosive charge, and c) a rotary electro-mechanical energising means operably electrically connected to and energised by a remote controlled operating system wherein, in use, the mechanical firing mechanism when cocked is actuated either manually or by the energised rotary electro-mechanical energising means to cause the mechanical firing mechanism to fire and ignite the explosive charge to initiate burning of the shock tube.

Preferably, the shock tube initiator includes a safety mechanism adapted to allow the mechanical firing mechanism to fire and ignite the explosive charge only when the safety mechanism is moved from a safe mode position to an armed position.

Preferably, the shock tube initiator includes an actuating means adapted to be positioned between and engageable with the rotary electro-mechanical energising means and the firing mechanism and wherein the actuating means is adapted to be actuated either by the rotary electro-mechanical energising means, when energised, or manually to allow the cockable mechanical firing mechanism, when cocked, to fire and ignite said explosive charge when the safety mechanism is in the armed position.

Preferably, the rotary electro-mechanical energising means is a rotary solenoid having a rotary shaft adapted to engage with the actuating means.

Preferably, a cam having a camming surface adapted to be positioned between the rotary shaft of the solenoid and the actuating means such that, when the solenoid is energised, the rotary motion of the rotary shaft, via the cam, imparts a linear motion to the actuating means.

Preferably, the cam is a helical cam.

Preferably, the actuating means includes a first sear having one end operably connected to the cam and the other end having engaging surface adapted to engage with the mechanical firing mechanism so as to releasably retain the mechanical firing mechanism in a cocked state until the first sear is actuated, either by the energised solenoid or manually, whereby upon actuation the first sear is disengaged from the cocked mechanical firing mechanism so that the mechanical firing mechanism is able to fire and ignite said explosive charge.

Preferably, the shock tube initiator is a dual shock tube initiator having two shock tube coupling means, a first and second coupling means, wherein each shock tube coupling means is adapted to allow one end of a shock tube coupled thereto.

Preferably, each coupling means includes a firing pin therein adapted, upon contact with the firing mechanism, to ignite said explosive charge so as to initiate burning of the shock tube coupled to the coupling means.

Preferably, the coupling means and firing pin are modular and interchangeable.

Preferably, the mechanical firing mechanism includes at least one rotating sprung loaded hammer rotatable from a cocked state under the action of biasing means to a firing state in which a face of the hammer is adapted to strike the firing pin to initiate ignition of said explosive charge.

Preferably, the mechanical firing mechanism includes two sprung loaded hammers rotatable about a common axis such that a first hammer is adapted to strike a first firing pin in the first coupling means and the second hammer adapted to strike a second firing pin in the second coupling means.

Preferably, the engaging surface of the first sear is engageable with the first hammer so as to releasably retain the first hammer in said cocked state until the first sear is actuated.

Preferably, the actuation means includes a second sear positioned parallel in a spaced apart relationship to the first sear, wherein the second sear includes an engaging surface engageable with the second hammer so as to releasably retain the second hammer in said cocked state until the first sear is actuated.

Preferably, the second sear includes an interrupter sear means adapted to upon actuation of the first sear and rotation of the first hammer to cause the second sear to disengage from the second hammer to allow the second hammer to rotate.

Preferably, the first sear is actuated by the solenoid when energised or is actuated manually by a decocking means in contact with the first sear, and wherein the decocking means when manually actuated causes the first sear to disengage from the first hammer to allow the second hammer to rotate.

Preferably, the decocking means includes a rotatable lever adapted to rotate between two positions, wherein the first position the lever is in a safe mode position whereby the lever is in contact with the first sear so as to prevent the first sear disengaging from the first hammer and wherein the second position the lever is in an armed position whereby the lever causes the first sear to disengage from the first hammer to allow the first hammer to rotate.

Preferably, when the lever is in the armed position, the decocking means prevents the hammers being cocked or recocked.

Preferably, the mechanical firing mechanism has a cocking means adapted to rotate the hammers from an uncocked state to a cocked state.

Preferably, the cocking means includes a two-way cocking lever with a rotary cocking cam wherein rotation of the two-way cocking lever in a first direction causes the rotary cocking cam to rotate the first hammer from a uncocked state to a cocked state and subsequent rotation of the two-way cocking lever in a second direction causes the rotary cocking cam to rotate the second hammer from a uncocked state to a cocked state.

Preferably, the rotary cocking cam includes a circular disc having an upper surface with a central shaft adapted to be coupled to the two-way cocking lever and having on a lower surface a cam shaft offset to the central axis of the circular disc wherein the offset cam shaft is engageable with each respective hammer when the two-way cocking lever is rotated in said first and second directions.

Preferably, the circular disc has two spaced apart recesses on the outer circumferential edge of the circular disc wherein the two spaced apart recesses cooperate with the safety mechanism such that when the safety mechanism is in the safe mode position each recess engages with a respective shaft of the safety mechanism so that the hammers are prevented from being fired unintentionally once the hammers are in the cocked state and, when the safety mechanism is in the armed position the recesses are disengaged from the shafts of the safety mechanism to enable hammers to rotate from the cocked state to cause firing of the shock tube initiator upon actuation of the sear.

Preferably, the safety mechanism includes two rotatable safety levers that rotate between said safe mode position and said armed position wherein each safety lever has a shaft that is adapted to engage with a respective recess of the rotary cocking cam when the safety lever is in said safe mode position and is adapted to disengageable from the recess of the rotary cocking cam when the safety lever is in the armed position.

Preferably, the safety mechanism is adapted to be positioned between the first and second coupling means and the hammers so as to prevent contact between the hammers and the firing pins when the safety mechanism is in the safe mode position.

In a further aspect the invention resides in a method of use of a shock tube initiator including the steps of:

a) placing a shot shell primer containing an explosive charge within at least one coupling means having a firing pin therein,
b) coupling to the coupling means one end of a shock tube that has a blasting means at its other end,
c) electrically connecting a rotary electro-mechanical energising means to a remote controlled operating system adapted to electrically energise the rotary electro-mechanical energising means upon the remote controlled operating system receiving an energising signal,
d) cocking a mechanical firing mechanism positioned between the coupling means and the rotary electro-mechanical energising means, wherein the mechanical firing mechanism s adapted to fire the firing pin and ignite the explosive charge to initiate burning of the shock tube, and
e) actuating firing of the mechanical firing mechanism by either:
   i. sending an energising signal to the remote controlled operating system to electrically energise the rotary electro-mechanical energising means so that the energised rotary electro-mechanical energising means causes an actuating means positioned between the rotary electro-mechanical energising means and the mechanical firing mechanism to actuate the mechanical firing mechanism, or ii. manually operating the actuation means to actuate the mechanical firing mechanism.

In another further aspect the invention resides in a method of use of a shock tube initiator including the steps of:

a) positioning a safety mechanism in a safe mode position to prevent the shock tube initiator from initiating, b) placing a shot shell primer containing an explosive charge within at least one coupling means having a firing pin therein, c) coupling to the coupling means one end of a shock tube that has a blasting means at its other end, d) electrically connecting a rotary electro-mechanical energising means to a remote controlled operating system adapted to electrically energise the rotary electro-mechanical energising means upon the remote controlled operating system receiving an energising signal, e) cocking a mechanical firing mechanism positioned between the coupling means and the rotary electro-mechanical energising means, wherein the mechanical firing mechanism is adapted to fire the firing pin and ignite the explosive charge to initiate burning of the shock tube, f) positioning the safety mechanism to an armed mode to allow the initiation of the shock tube initiator to commence, and g) actuating firing of the mechanical firing mechanism by either:

i. sending an energising signal to the remote controlled operating system to electrically energise the rotary electro-mechanical energising means so that the energised rotary electro-mechanical energising means causes an actuating means positioned between the rotary electro-mechanical energising means and the mechanical firing mechanism to actuate the mechanical firing mechanism, or ii. manually operating the actuation means to actuate the mechanical firing mechanism.

Any other aspects hereinafter described.

BRIEF DESCRIPTION

The invention will now be described, by way of example only, by reference to the accompanying drawings:

FIG. 1 is a perspective view of a shock tube initiator constructed in accordance with a preferred embodiment of the invention.

FIG. 2 is an diagrammatic view of components for the shock tube initiator in accordance with the preferred embodiment of the invention.

FIG. 3 is a top view of the shock tube initiator in a cocked position in accordance to the preferred embodiment of the invention.

FIG. 4 is a bottom view of the shock tube initiator in a cocked position in accordance with the preferred embodiment of the invention.

FIGS. 5 and 6 shows the main individual components of the shock tube initiator system in accordance to the preferred embodiment of the invention.

DESCRIPTION OF DRAWINGS

The following description will describe the invention in relation to a preferred embodiment of the invention namely a dual shock tube initiator.

The dual shock initiator (hereinafter 'STI') is designated to be activated either manually or by remotely by known remote controlled means such as a digital radio controlled system, typically the applicants own PRIME™ UHF Digital Radio Controlled system. Dual shock tube initiators are preferably used in that they offer better reliability in the initiation of the explosive than single shock tube initiators to the extent if a particular shock tube fails or becomes redundant the other shock tube will still allow initiation of the explosive.

Turning to the drawings which show in detail the preferred embodiment of the invention.

Figure 1:
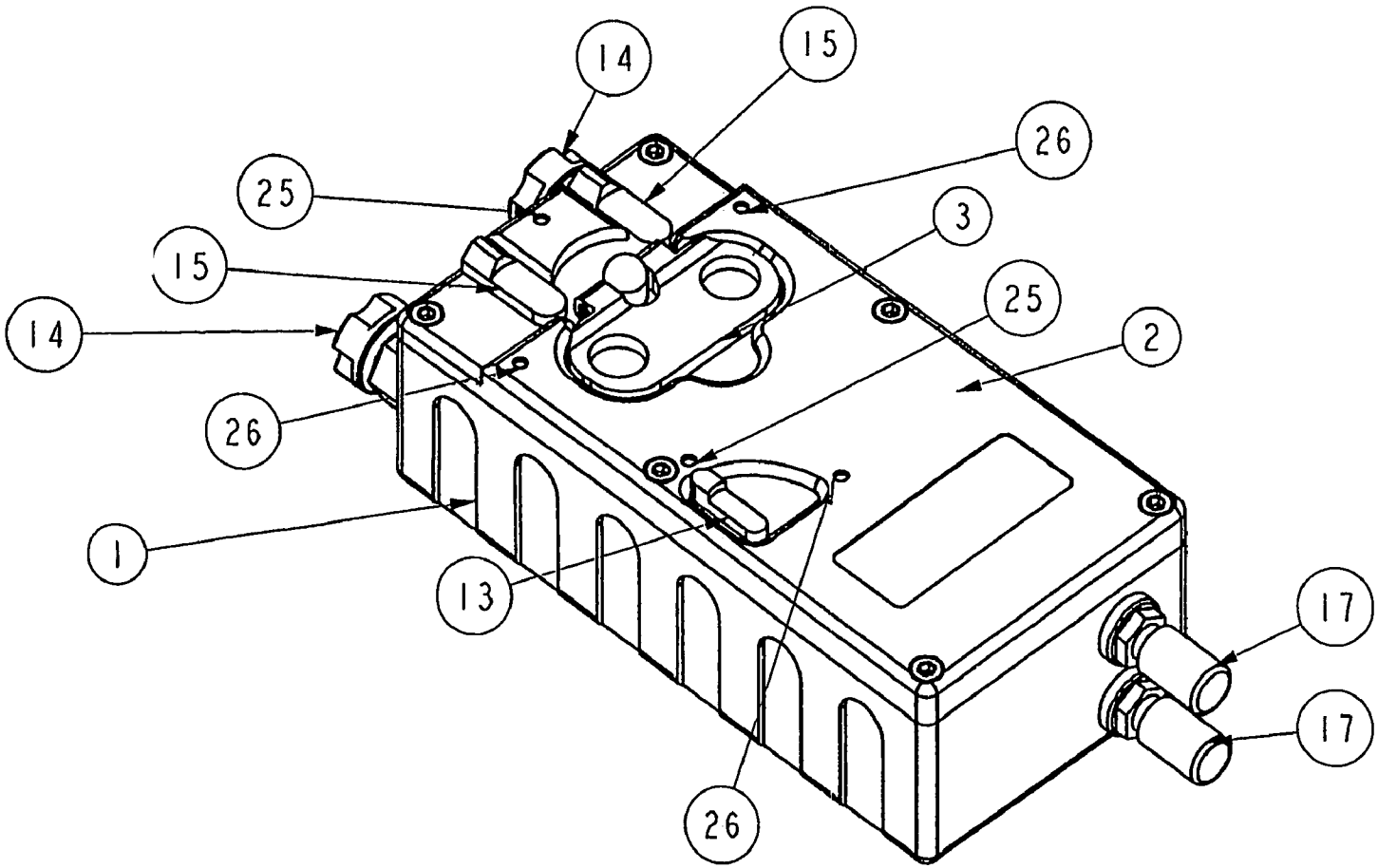

FIG. 1 shows a perspective view of an assembled shock tube initiator system having a main housing 1 and a cover plate 2. The main housing 1 consists of a bottom wall and four side walls, one of which has apertures for accommodating and extending there through a coupling means such as a firing pin housing 8 (FIG. 2, FIG. 5) to which snap caps 14 are fitted when the STI is not in use. Each firing pin housing 8 is adapted to accept a shock tube, either US or European standard shock tubes. Another side wall, typically the side wall directly opposite to the side wall accommodating the firing pin housings, has apertures for accommodating and extending there through electrical connectors 17 that, in use, are electrically connected by electrical wire or cord or other suitable means to a remote controller, such as a remote operated digital radio controlled system, typically the applicants own PRIME™ UHF system. A signal received by the remote controller is relayed electrically to the STI in order to activate the STI.

The cover plate 2 is configured to accommodate external components necessary to cock and engage or disengage the safety mechanisms. Mounted externally on the upper surface of the cover plate 2 is a two way cocking key 3 and two safety mechanisms, one consisting of two safety levers 15, preferably manually operated, and the other safety mechanism consisting of a decocking lever 13. Also marked on the cover plate in the region of the safety levers 15 and decocking lever 13 are markings 25 and 26. Marking 25, usually coloured white, indicates that the safety levers 15 and decocking lever 13 are in a safe mode (ie STI not armed). Marking 26, usually coloured red, indicates that the safety levers 15 and decocking lever 13 are in an armed mode (ie STI is armed and ready to be initiated either manually or by remote control). In order to cock the STI both safety levers 15 must be in the safe mode position 25 and to enable firing of the STI the safety levers 15 must be in the armed mode position 26.

Figure 2:
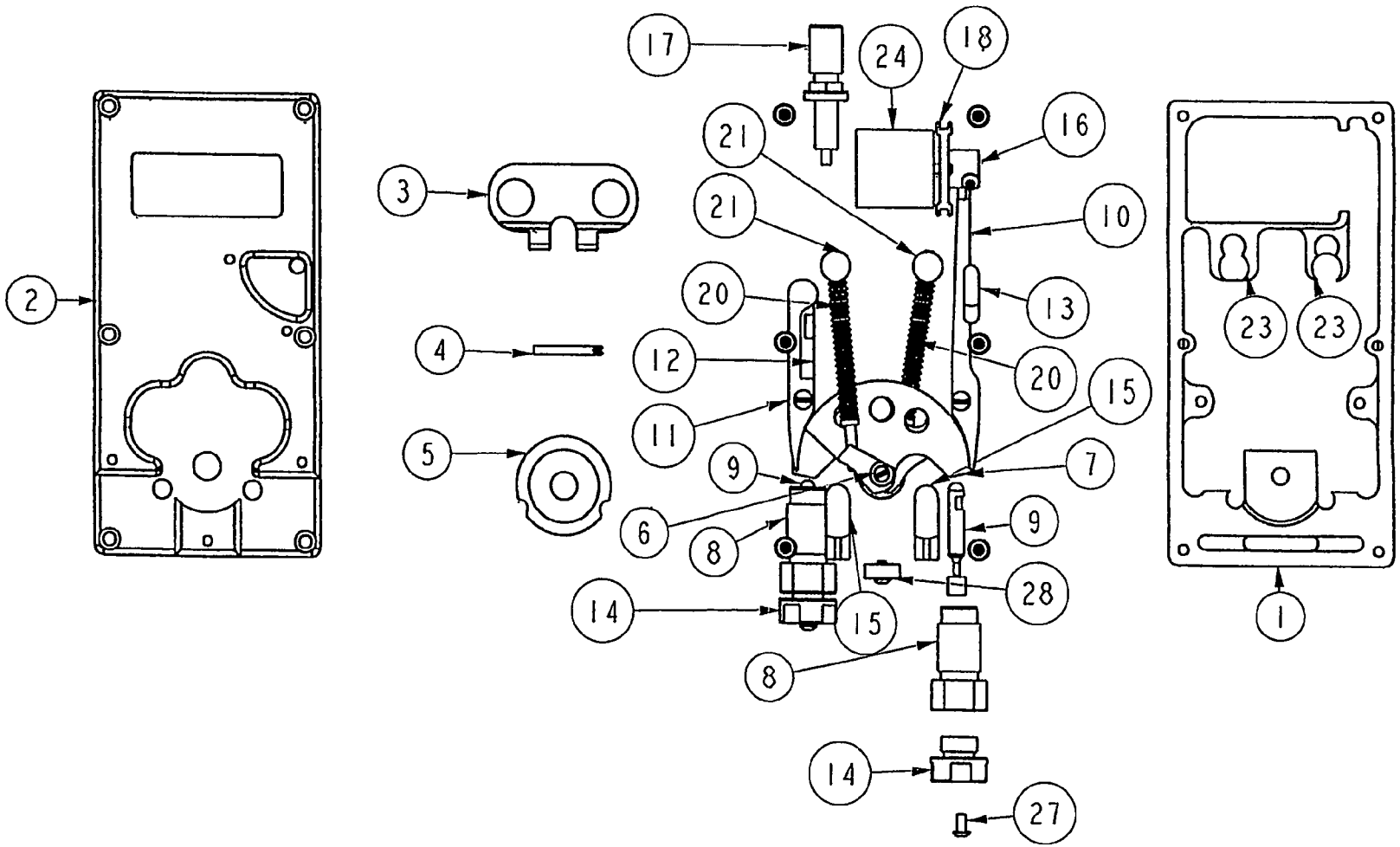
Figure 5:
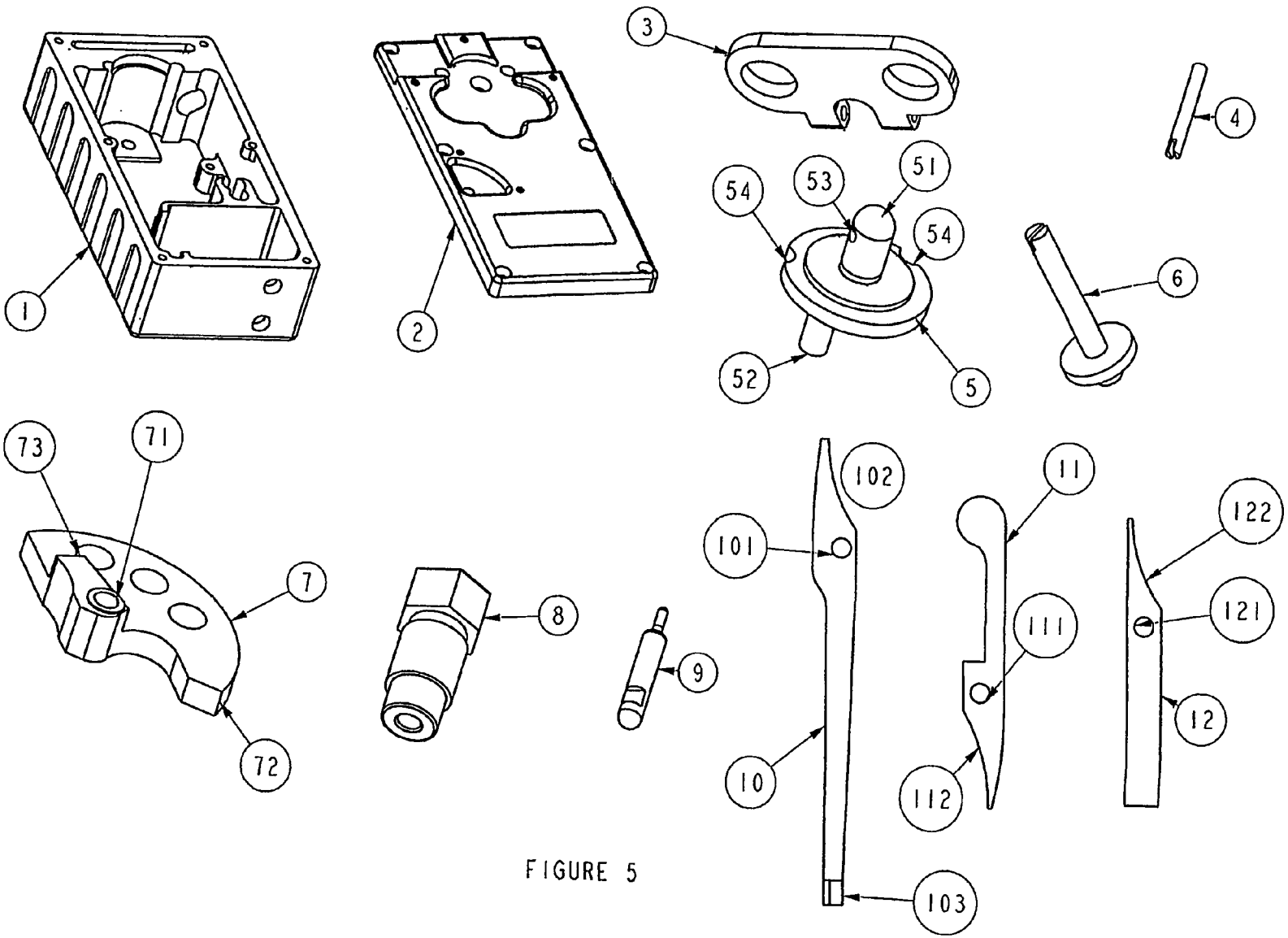
Figure 6:
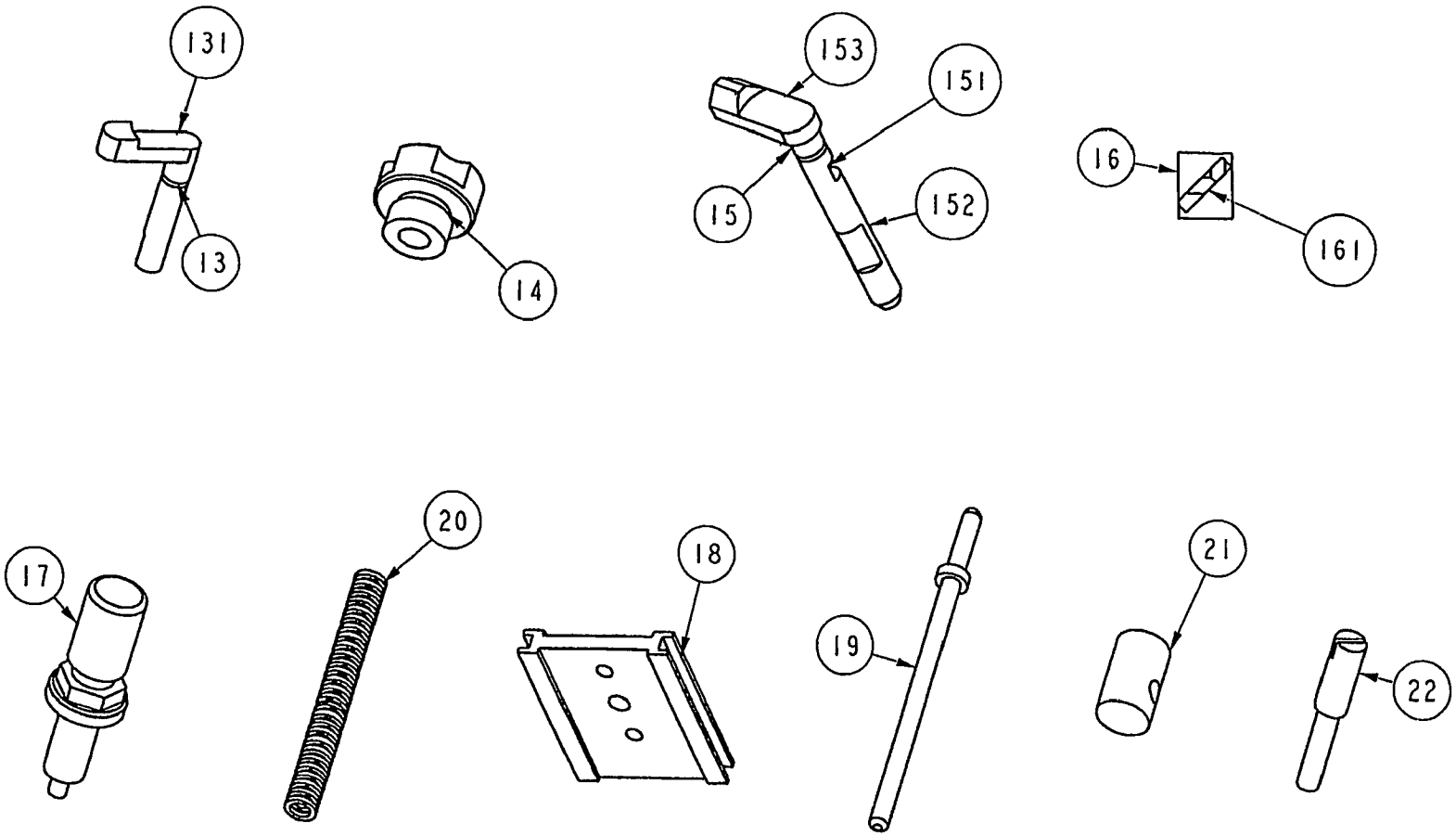

Turning to FIG. 2 with reference to FIGS. 5 and 6, there is shown an exploded type view of the internal components housed within and attached to the main housing 1 and cover plate 2. The internal surfaces of the main housing and internal wall of cover plate 2 are configured and arranged to accommodate internal components in an economical and effective arrangement.

The STI includes a rotary solenoid 24 or any other suitable electro-mechanical energiser connected to the electrical connectors 17. The solenoid 24 is retained in position within the main housing 1 by a retaining plate 18. The solenoid 24 has a rotary shaft that is attached to a helical cam 16 having a camming surface 161 (FIG. 6). The helical cam 16 accommodates one end of a sear bar 10 such that as the solenoid is activated 24, the rotary motion the rotary shaft of the solenoid 24 imparts, via the cam 16, a linear motion to the sear bar 10. The sear bar 10 extends in a forward direction parallel to the longitudinal axis of the main housing 1. As is shown in FIG. 5 the sear bar 10 has an opening 101 for accommodating a sear screw 22 and hammer engaging surface 102 at an end distal to a helical cam engaging end 103. The helical cam engaging end 103 is configured and adapted to cooperate with the cam 16 in order to impart linear motion to the sear bar.

The STI has a firing mechanism consisting of two individual rotating sprung loaded hammers 7 rotatable about a main shaft 6. Each hammer 7 upon initiation is adapted to strike a respective firing pin 9. Each hammer 7 has an aperture 71 (FIG. 5) for receiving the main shaft 6 therein and a hammer strike face 72 (FIG. 5) which is adapted to make contact with the firing pin 9. Each hammer 7 is sprung loaded under the action of biasing assembly consisting of a spring shaft 19 (FIG. 6) and spring 20. One end of each spring shaft 19 is mounted and coupled to the main housing 1 with the aid of a spring shaft guide 21 (FIG. 6) which slides into a cooperating guide receiver 23 on an internal surface of the main housing 1. Each spring 20 is positioned on the respective spring shaft 19 under tension. The other end of the spring shaft 19 is in direct contact with an abutment 73 on each respective hammer 7 such that as the STI is initiated each hammer is caused, due to the tensioned springs 20, to rotate at such a force to strike and cause the firing pin 9 to fire.

Each firing pin 9 has a hammer striking end and a firing point end distal therefrom. Each firing pin 9 is housed within a respective firing pin housing 8 in which a shot shell primer is placed to be initiated by the firing pin 9 and then the shock tube and finally a remote blasting cap. When not in use snap caps 14 can be attached to a free end of each firing pin housing in order to protect the firing pins 9. The snap caps 14 are attached to fitment 28 on the main housing 28 by a cap screw 27 and nylon string or similar in order to prevent the snaps caps 14 from being misplaced.

Opposite to and positioned in the same direction as the sear bar 10 is a secondary sear bar 12 and an interrupter sear 11. The sear bar 12 and interrupter sear 11 have respective apertures for accommodating sear screw 22 and each have hammer engaging surfaces 112, 122. The sear bar 12 and interrupter sear 11 are joined together by sear screw 22 and are adapted to come into contact with the opposite hammer to which main sear bar 10 is in contact with. The main sear bar 10 and the sear bar 12 & interrupter sear 11 combination, under the action of frictional engagement of hammer engaging surfaces 102, 112 & 122, prevent the hammers 7 from striking the firing pins 9 until such time the STI is to be initiated.

Figure 4:
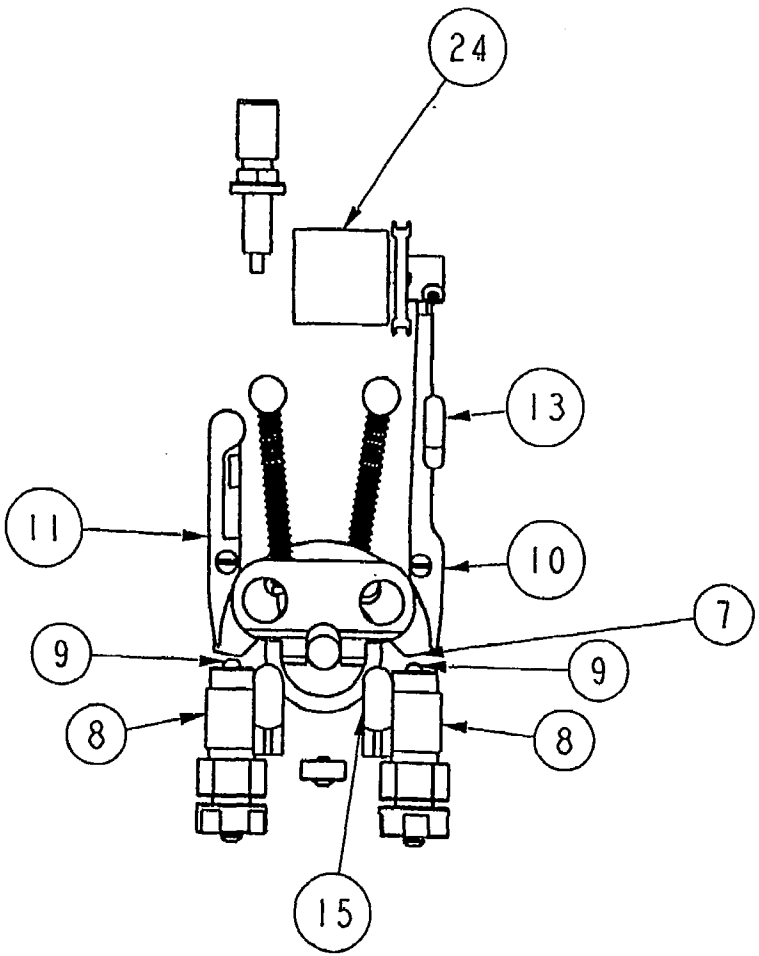
Figure 3:
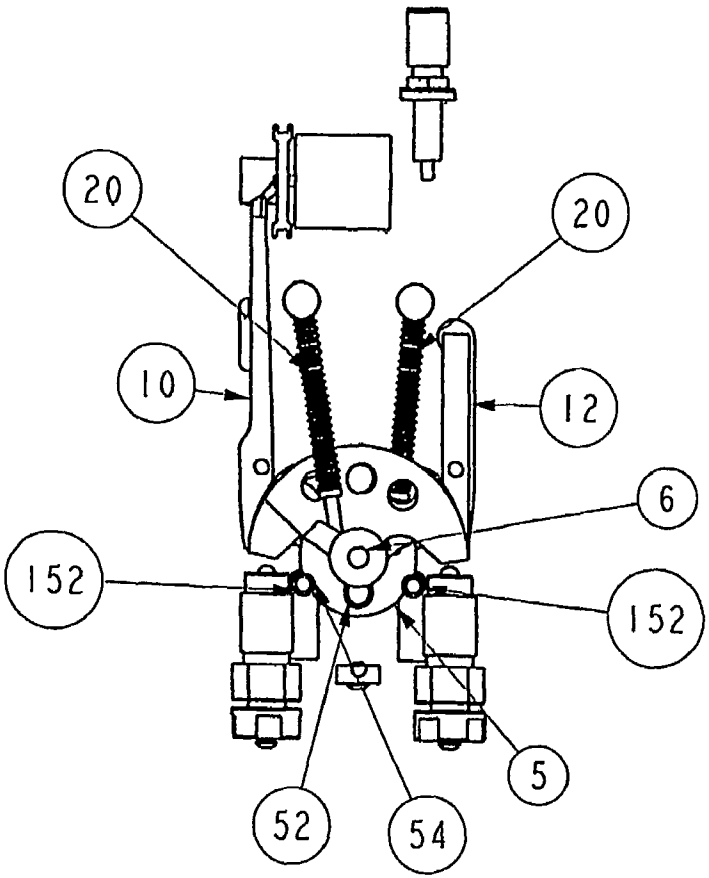

A cocking cam 5 (FIG. 5), generally of a circular disc shape, has on one side a central shaft 51 with a transverse opening 53 for accommodating a key pin 4 to allow the cocking key 3 to be attached. On the other side is an offset cam shaft 52 adapted to, in use, assist in cocking the hammers in a pre-firing position as is shown in FIGS. 3 and 4.

The outer circumferential edge of the circular disc of the cam 5 has two spaced apart notches 54 configured and adapted to receive a portion of the shaft 152 of a respective safety lever 15 when the safety lever 15 is in the safe mode position 25. Each safety lever 15 has a notch 151 configured and adapted to receive a portion of the cam 5 when the safety levers 15 are in the armed mode position 26.

The assembled STI is water and air tight and this is achieved by sealing all rotating shafts and couplings extending through the main housing 1 or cover plate 2 with suitable seals, such as toroidal rings. The cover plate is sealed to the main housing by suitable sealant such as loctite aviation sealant.

The firing pins 9 are of a floating type. The firing pin housing 8 and the firing pins are interchangeable in order to accommodate differing firing pin/shock tube arrangements such as those used by US or Europe.

In its preferred form of use the STI has two firing pin assemblies so that dual shock tubes can be connected to the system.

In use a remote controller is connected to the STI via electrical connections 17. Shot shell primer is positioned within the firing pin housing 8 and then shock tubes are connected to the firing pin housing 8 in the usual manner. With the safety levers 15 in the safe mode position 25, the two way cocking key 3 is rotated clockwise and then anticlockwise in order to position each individual rotating sprung loaded hammer 7 in a cocked position. The hammers are held and retained in that position by each respective sear bar 10, 12. The shafts 152 of each safety lever 15, when in the safe mode position 25, engages with a respective notch 54 on the rotary cocking cam 5 and are positioned between the firing pin housings 8 and the hammer strike faces 72 of the hammers 7. Therefore preventing contact between the hammers 7 and the firing pins 9 so that unintentional firing of the initiator is avoided.

Activation of the STI once it has been cocked can be either done manually or electrically via the remote controller connected to the STI. Firstly, the safety levers 15 are rotated from the safe mode position 25 to the armed mode position 26 such that each safety levers 15 shaft 152 is no longer held within respective notches 54 of the rotary cocking cam 5 and the rotary cocking cam 5 is able to pass through notches 151 on the shafts of safety levers 15. The hammers 7 are now able to rotate in the direction of the firing pins 9 once the sear bars 10, 12 are released from engaging the hammers. The STI now is primed for initiation which can be done in two ways either remote or manual initiation.

Remote initiation is achieved by sending a signal to the remote controller which then sends an electric signal via the electrical connectors 17 to the rotary solenoid 24. The energised rotary solenoid 24 then imparts rotary motion of its shaft to the helical cam 16 which in turn imparts linear motion to the sear bar 10. The linear motion imparted to the sear bar 10 causes the sear bar 10 to disengage from the respective hammer 7 it was engaging thus allowing that sprung loaded hammer 7 to rotate. The rotation of the first hammer 7 activates the interrupter sear 11 to release the other sear bar 12 from its engagement with the second hammer. Due to both hammers being sprung loaded each hammer 7 rotates at a sufficient speed so that the hammer strike faces 72 contact the firing pins 9 with a sufficient energy to fire the shell shot primer and thus initiate each shock tube.

Manual operation of the STI is achieved by causing the decocking lever 13 having a shaft in contact with the sear bar 10 to be rotated from the safe mode position 25 to the armed mode position 26. Rotation of the decocking lever causes the sear bar 10 to be moved out of engagement with its respective hammer 7. Therefore releasing the hammers 7 in the same manner discussed above.

Whilst the decocking lever 13 is in the armed mode position 26 the STI cannot be cocked or recocked.

Upon 90-degrees rotation of the cocking mechanism sear engagement occurs, this creates a set or cocked state. This state is dictated by two sear bars 10, 12 equidistant from the central axis, the left sear bar 10 being of a length to achieve maximum mechanical advantage, and engages with a helical groove type cam 16 activated by a rotary solenoid.

Upon rotation of the helical cam 16 by the rotary solenoid the sear bar 10 is disengaged from the hammer causing rotation of the hammer, which in turn activates an interrupter type sear, linked to the other hammer and the inertia of that rotation releases the other hammer.

Two vertical shafts of the safety levers located between the firing pin assemblies and the hammer strike faces are set upon rotation to act as mechanical safeties. Rotation of 90 degrees of these shafts enables the STI not to be cocked whilst in the fire position, and prevents contact between the hammers and the firing pins. The de-cocking lever also prevents sear engagement whilst in the fire position.

Principles of motion in the STI are common to firearm manufacture and sear engagement loadings are normal to standard practices.

The housing of the STI system is constructed of a waterproof aluminium alloy containing the components necessary to trigger the dual firing mechanisms.

In order to operate STI as a remote controlled initiator, such as the PRIME™ UHF digital radio controlled system, is required. The combination of both components creates a unique, highly versatile, radio controlled, shock tube initiation system.

STI is adapted for use in conditions where electric detonators are not suitable, especially in high electro-magnetic fields.

The STI incorporates a mechanical firing mechanism and as such an internal power source is not required to de-cock or fire the STI manually.

The manual and remote initiation of the STI allows for the command detonation of shock tube at long range creating a unique remote shock tube initiation system.

Using the PRIME™ UHF digital radio controlled system, the operating range of the STI within an urban environment is 3 kms. In open terrain 3-5 kms could be expected, whilst under line of sight conditions, ranges of 10-25 kms are possible.

Even though the STI is preferably capable of initiating two shock tubes, it is envisaged without departing from the scope of the invention that the STI can be adapted to initiate a single shock tube. However, for greater reliability military shock tubes are generally dual types.

The STI has firing pin couplings which can easily be swapped with different couplings to handle different sized and threaded shock tube firing caps (USA vs European).

The firing pins 9 of the STI are separate and independent of the hammers 7.

The seal caps 14 which cover the firing pin housing 8 are to protect against water ingress and protect the firing pins in the event of firing without shock tubes fitted.

The decocking lever 13 serves two purposes; (1) when the safety levers 15 are engaged, allows the hammers 7 to be released without firing, (2) when the safety levers 15 are disengaged, allows the shock tube(s) to be initiated manually.

The STI is adapted and designed to function with shock tubes which are prefitted with percussion caps. Such prefitted shock tubes are immune to water ingress.

The preferred materials used in this system are:

Main housing—7075 tooling plate alloy

Hammers—mild steel, case hardened and phosphated.

Sear bars—gauge plate, surfaced hardened about engagement areas.

All other components, springs and screws, etc, stainless steel.

Safety levers and cocking key are mild steel phosphated.

Safety shafts are stainless steel 316.

Advantages a) Can be operated for distances up to 25 km.

b) Can be triggered by a low energy initiator.

c) Is waterproof.

d) Can be de-cocked or manually triggered.

e) Is protected from firing by integral safety levers.

f) Accepts commonly available percussion cap prefitted shock tubes.

g) Capable of being initiated by UHF/VHF digital radio controlled system, allowing for command detonation by remote control.

h) Incorporates a dual initiation system for ensured reliability.

i) Individual safety levers for each firing mechanism.

j) Modular firing pin assemblies to fit either US or European shock tube.

k) Rugged design for maximum reliability in harsh operating conditions.

Variations

Throughout the description of this specification the word "comprise" and variations of that word such as "comprises" and "comprising", are not intended to exclude other additives, components, integers or steps.

It will of course be realised that while the foregoing has been given by way of illustrative example of this invention, all such and other modifications and variations thereto as would be apparent to persons skilled in the art are deemed to fall within the broad scope and ambit of the appended claims of this invention as is herein set forth.

The invention claimed is:

1. A shock tube initiator for allowing the remote and/or manual initiation of at least one shock tube, wherein the shock tube initiator includes in combination:

a) at least one coupling means operably connected to a shock tube and wherein the coupling means is adapted to house a shot shell primer containing an explosive charge that upon firing initiates a burning of the shock tube, b) a cockable mechanical firing mechanism positioned proximal to and adjacent to the coupling means wherein the mechanical firing mechanism is adapted to ignite said explosive charge, c) a safety mechanism adapted to allow the mechanical firing mechanism to ignite said explosive charge only when the safety mechanism is moved from a safe mode position to an armed position, d) a rotary electro-mechanical energising means operably electrically connected to and energised by a remote controlled operating system, and e) an actuating means adapted to be positioned between and engageable with the rotary electro-mechanical energising means and the firing mechanism and wherein said actuating means is adapted to be actuated either by the rotary electro-mechanical energising means, when energised, or manually manipulated to allow the cockable mechanical firing mechanism when cocked, to fire and ignite said explosive charge to initiate burning of the at least one shock tube when the safety mechanism is in the armed position.

2. The shock tube initiator as claimed in claim 1 wherein the shock tube initiator is a dual shock tube initiator having two shock tube coupling means, a first and second coupling means, wherein each shock tube coupling means is adapted to allow one end of a shock tube coupled thereto.

3. The shock tube initiator as claimed in claim 2, wherein the rotary electro-mechanical energising means is a rotary solenoid having a rotary shaft adapted to engage with the actuating means.

4. The shock tube initiator as claimed in claim 3, wherein a cam having a camming surface is adapted to be positioned between the rotary shaft of the solenoid and the actuating means such that rotary motion of the rotary shaft, when the solenoid is energised, imparts, via the cam, a linear motion to the actuating means.

5. The shock tube initiator as claimed in claim 4, wherein the cam is a helical cam.

6. The shock tube initiator as claimed in claim 5, wherein the actuating means includes a first sear having one end adapted to be in connection with the cam and the other end having engaging surface adapted to engage with the mechanical firing mechanism so as to releasably retain the mechanical firing mechanism in a cocked state until the first sear is actuated, either by the energised solenoid or manually, whereby upon actuation the first sear is disengaged from the cocked mechanical firing mechanism so that the mechanical firing mechanism is able to fire and ignite said explosive charge.

7. The shock tube initiator as claimed in claim 6, wherein each coupling means includes a firing pin therein adapted, upon contact with the firing mechanism, to ignite said explosive charge so as to initiate burning of the shock tube coupled to the coupling means.

8. The shock tube initiator as claimed in claim 7, wherein the coupling means and firing pin are modular and interchangeable.

9. The shock tube initiator as claimed in claim 8, wherein the mechanical firing mechanism includes at least one rotating sprung loaded hammer rotatable from a cocked state under the action of biasing means to a firing state in which a face of the hammer is adapted to strike the firing pin to initiate ignition of said explosive charge.

10. The shock tube initiator as claimed in claim 9, wherein, the mechanical firing mechanism includes two sprung loaded hammers rotatable about a common axis such that a first hammer is adapted to strike a first firing pin in the first coupling means and the second hammer adapted to strike a second firing pin in the second coupling means.

11. The shock tube initiator as claimed in claim 10, wherein the engaging surface of the first sear is engageable with the first hammer so as to releasably retain the first hammer in said cocked state until the first sear is actuated.

12. The shock tube initiator as claimed in claim 11, wherein the actuation means includes a second sear positioned parallel in a spaced apart relationship to the first sear, wherein the second sear includes an engaging surface engageable with the second hammer so as to releasably retain the second hammer in said cocked state until the first sear is actuated.

13. The shock tube initiator as claimed in claim 12, wherein the second sear includes an interrupter sear means adapted to upon actuation of the first sear and rotation of the first hammer to cause the second sear to disengage from the second hammer to allow the second hammer to rotate.

14. The shock tube initiator as claimed in claim 13, wherein the first sear is actuated by the solenoid when energised or actuated manually by a decocking means in contact with the first sear, wherein the decocking means is adapted upon manual manipulation to cause the first sear to disengage from the first hammer to allow the second hammer to rotate.

15. The shock tube initiator as claimed in claim 14, wherein the decocking means includes a rotatable lever adapted to rotate between two positions, wherein the first position the lever is in a safe mode position whereby the lever is in contact with the first sear so as to prevent the first sear disengaging from the first hammer and wherein the second position the lever is in an armed position whereby the lever caused the first sear to disengage from the first hammer to allow the first hammer to rotate.

16. The shock tube initiator as claimed in claim 15, wherein the decocking means when the lever is in the armed position prevents the hammers to be cocked or recocked.

17. The shock tube initiator as claimed in claim 16, wherein the mechanical firing mechanism has a cocking means adapted to rotate the hammers from an uncocked state to a cocked state.

18. The shock tube initiator as claimed in claim 17, wherein the cocking means includes a two-way cocking lever with a rotary cocking cam wherein rotation of the two-way cocking lever in a first direction causes the rotary cocking cam to rotate the first hammer from a uncocked state to a cocked state and subsequent rotation of the two-way cocking lever in a second direction causes the rotary cocking cam to rotate the second hammer from a uncocked state to a cocked state.

19. The shock tube initiator as claimed in claim 18, wherein the rotary cocking cam includes a circular disc having an upper surface with a central shaft coupled to the two-way cocking lever and having on a lower surface a cam shaft offset to the central axis of the circular disc wherein the offset cam shaft is adapted to engage with each respective hammer when the two-way cocking lever is rotated in said first and second directions.

20. The shock tube initiator as claimed in claim 19, wherein the circular disc has two spaced apart recesses on the outer circumferential edge of the circular disc wherein the two spaced apart recesses cooperate with the safety mechanism such that when the safety mechanism is in the safe mode position each recess engages with a respective shaft of the safety mechanism so that the hammers are unable to be fired unintentionally once the hammers are in the cocked state and when the safety mechanism is in the armed position the recesses are disengaged from the shafts of the safety mechanism to enable hammers to rotate from the cocked state to cause firing of the shock tube initiator upon actuation of the sear.

21. The shock tube initiator as claimed in claim 20, wherein the safety mechanism includes two rotatable safety levers that are rotateable between said safe mode position and said armed position wherein each safety level has a shaft that is adapted to engage with a respective recess of the rotary cocking cam when the safety lever is in said mode position and is adapted to disengageable from the recess of the rotary cocking cam when the safety lever is in the armed position.

22. The shock tube initiator as claimed in claim 21, wherein the safety mechanism is adapted to be positioned between the first and second coupling means and the hammers so as to prevent contact between the hammers and the firing pins when the safety mechanism is in the safe mode position.

23. A shock tube initiator for allowing the remote and/or manual initiation of at least one shock tube, wherein the shock tube initiator includes in combination:

a) a least one coupling means operably connected to a shock tube and wherein the coupling means is adapted to house a shot shell primer containing an explosive charge that upon firing initiates burning of the shock tube, b) a cockable mechanical firing mechanism positioned proximal and adjacent to the coupling means wherein the mechanical firing mechanism is adapted to ignite said explosive charge, and c) a rotary electro-mechanical energising means operably electrically connected to and energised by a remote controlled operating system wherein, in use, the mechanical firing mechanism when cocked is actuated either manually or by the energised rotary electro-mechanical energising means to cause the mechanical firing mechanism to fire and ignite the explosive charge to initiate burning of the shock tube.

24. The shock tube initiator as claimed in claim 23, wherein the shock tube initiator includes a safety mechanism adapted to allow the mechanical firing mechanism to fire and ignite the explosive charge only when the safety mechanism is moved from a safe mode position to an armed position.

25. The shock tube initiator as claimed in claim 24, wherein the shock tube initiator includes an actuating means adapted to be positioned between and engageable with the rotary electro-mechanical energising means and the firing mechanism and wherein the actuating means is adapted to be actuated either by the rotary electro-mechanical energising means, when energised, or manually manipulated to allow the cockable mechanical firing mechanism, when cocked, to fire and ignite said explosive charge when the safety mechanism is in the armed position.

26. A method of using the shock tube initiator of claim 23 including the steps of:

a) placing a shot shell primer containing an explosive charge within at least one coupling means having a firing pin therein, b) coupling to the coupling means one end of a shock tube that has a blasting means at its other end, c) electrically connecting a rotary electro-mechanical energising means to a remote controlled operating system adapted to electrically energise the rotary electro-mechanical energising means upon the remote controlled operating system receiving an energising signal, d) cocking a mechanical firing mechanism positioned between the coupling means and the rotary electro-mechanical energising means, wherein the mechanical firing mechanism is adapted to fire the firing pin and ignite the explosive charge to initiate burning of the shock tube, and e) actuating firing of the mechanical firing mechanism by either:

i. sending an energising signal to the remote controlled operating system to electrically energise the rotary electro-mechanical energising means so that the energised rotary electro-mechanical energising means causes an actuating means positioned between the rotary electro-mechanical energising means and the mechanical firing mechanism to actuate the mechanical firing mechanism, or ii. manually operating the actuation means to actuate the mechanical firing mechanism.

27. A method of use of a shock tube initiator including the steps of:

a) positioning a safety mechanism in a safe mode position to prevent the shock tube initiator from initiating, b) placing a shot shell primer containing an explosive charge within at least one coupling means having a firing pin therein, c) coupling to the coupling means one end of a shock tube that has a blasting means at its other end, d) electrically connecting a rotary electro-mechanical energising means to a remote controlled operating system adapted to electrically energise the rotary electro-mechanical energising means upon the remote controlled operating system receiving an energising signal, e) cocking a mechanical firing mechanism positioned between the coupling means and the rotary electro-mechanical energising means, wherein the mechanical firing mechanism is adapted to fire the firing pin and ignite the explosive charge to initiate burning of the shock tube, f) positioning the safety mechanism to an armed mode to allow the initiation of the shock tube initiator to commence, and g) actuating firing of the mechanical firing mechanism by either:

i. sending an energising signal to the remote controlled operating system to electrically energise the rotary electro-mechanical energising means so that the energised rotary electro-mechanical energising means causes an actuating means positioned between the rotary electro-mechanical energising means and the mechanical firing mechanism to actuate the mechanical firing mechanism, or ii. manually operating the actuation means to actuate the mechanical firing mechanism.

* * * * *

UNITED STATES PATENT AND TRADEMARK OFFICE

CERTIFICATE OF CORRECTION

PATENT NO. : 7,665,401 B2
APPLICATION NO. : 10/596138
DATED : February 23, 2010
INVENTOR(S) : Ballantine et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 876 days.

Signed and Sealed this

Twenty-eighth Day of December, 2010

David J. Kappos

David J. Kappos
*Director of the United States Patent and Trademark Office*